US007597181B2

(12) United States Patent
Illedits et al.

(10) Patent No.: US 7,597,181 B2
(45) Date of Patent: Oct. 6, 2009

(54) ESCALATOR WITH COMB BRUSHES, STEP COMB OF SUCH AN ESCALATOR, AND METHOD FOR MODERNIZING AN ESCALATOR

(75) Inventors: Thomas Illedits, Neufeld (AT); Michael Matheisl, Vosendorf (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/846,608

(22) Filed: Aug. 29, 2007

(65) Prior Publication Data

US 2008/0236992 A1 Oct. 2, 2008

(30) Foreign Application Priority Data

Aug. 29, 2006 (EP) ..... 06119739

(51) Int. Cl.
*B66B 21/02* (2006.01)

(52) U.S. Cl. ..... 198/326; 198/325

(58) Field of Classification Search ..... 198/321, 198/323, 325, 326, 496
See application file for complete search history.

(56) References Cited

U.S. PATENT DOCUMENTS

| | | | | |
|---|---|---|---|---|
| 7,204,361 | B2 * | 4/2007 | Illedits | 198/326 |
| 7,264,105 | B2 * | 9/2007 | Illedits | 198/326 |
| 2001/0025764 | A1 * | 10/2001 | Neszmerak | 198/326 |
| 2006/0102448 | A1 * | 5/2006 | Illedits | 198/326 |

FOREIGN PATENT DOCUMENTS

| | | | |
|---|---|---|---|
| JP | 08 198572 | A | 8/1996 |
| JP | 2001 335275 | A | 12/2001 |

* cited by examiner

*Primary Examiner*—James R Bidwell
(74) *Attorney, Agent, or Firm*—Ladas & Parry LLP

(57) ABSTRACT

The invention relates to an escalator with steps or a moving walk with pallets that has a step comb or pallet comb respectively with comb teeth, wherein comb brushes on the step comb or pallet comb are arranged in approximately parallel direction to the comb teeth.

11 Claims, 3 Drawing Sheets

ESCALATOR WITH COMB BRUSHES, STEP COMB OF SUCH AN ESCALATOR, AND METHOD FOR MODERNIZING AN ESCALATOR

The invention relates to an escalator with a step comb, a step comb of such an escalator, and a method for modernizing an escalator. The invention is equally applicable to escalators and moving walks.

BACKGROUND OF THE INVENTION

The steps of a normal escalator are fastened to two transport chains and together with the latter form an endless circulating step band that runs over a pair of transport chain wheels at both ends of the escalator, one transport chain wheel pair belonging to a drive station and driving and reversing the step band and the other chain wheel pair being part of a step band reversing station. The individual steps of the step band are each equipped with two front and two back guide rollers on which the steps are guided in a positionally dependent defined position by guide rails and reversing cams that are mainly fastened to the supporting construction of the escalator.

The steps of the escalator run along a predetermined path that is defined at the sides by stationary skirt panels. A passenger that is present on the step tread surface of a step stands facing the step riser surface of the preceding step. In the exit area, the following step slides along the step riser surface of the preceding step and then under a comb plate, so that the step tread surfaces of the preceding and following step come onto the same level and disappear under the comb plate. The comb plate has a step comb that has comb teeth. The step tread surfaces of the steps have ribs that pass between the comb teeth to remove objects that could be present in the ribs before the steps disappear under the comb plate and return to the other end of the escalator. There is, however, nevertheless a hazardous or dangerous gap between the ribs of a step and the step comb.

To compensate for tolerances, a gap must remain between the ribs of a step and the step comb. Otherwise, considerable friction would be generated that would cause inadmissible heating and would increase escalator driving power and wear. Thus, a gap or air gap must remain between the ribs of a step and the step comb.

Such a gap or air gap is a safety risk. Because of the play that is present, the gap width can become a large area so that insertion of a shoe edge, scarf, high heel, skirt hem, or hand, especially by children, becomes possible. In consequence, the danger of contusions and other injuries to passengers is not ruled out.

Injury to persons in the area of the comb plate caused by the relative movement between the moving steps and the stationary comb plate is a main problem of conventional escalators. In addition, if an object that is present on the moving step comes into contact with the step comb, the object can be pulled by friction and relative movement into the gap, especially at that comb plate where passengers leave the escalator. This is the upper comb plate when traveling up, and when traveling down, the lower comb plate.

Patent JP2000000529 discloses brushes that are arranged on a comb plate to clean the step tread surface of the step. In this device, the brushes are present at a certain spaced distance behind the step comb, so that objects can become jammed in the underlying gap. Moreover, the brushes are in contact with the step tread surface of the step, which can damage the step tread surface and cause noises. It has also proved disadvantageous that the brushes have a very short life due to the constant friction with the step tread surface. The forces that are exerted by the steps damage the structure of the brushes and cause their shortening. They have also been proven to have insufficient form, load, and contact stability.

The objective of the invention is therefore to create an escalator or moving walk that does not have disadvantages of the prior art and that essentially increases the operating safety and significantly lengthens life of the step tread-comb plate system while being simple to manufacture.

BRIEF DESCRIPTION OF THE INVENTION

According to the invention it is foreseen that, in an escalator with steps that have a step comb with comb teeth, comb brushes are located on the step comb and are arranged in an approximately parallel direction to the comb teeth.

Comb brushes that are positioned in the manner described above provide for needed prevention of contact of objects with the step comb. The comb brushes prevent contact of objects with the step comb and at the same time prevent penetration of the objects into the gap between the ribs of the step tread surface and the step comb. Foreign bodies such as, for example, shoes, umbrellas, scarves, handbag straps, plastic bags or other objects are brushed away by means of the comb brushes, the comb brushes pushing or brushing the objects out of the danger area. The foreign bodies are brushed out and transported via the comb brushes onto the step combs. Consequently, pinching or wedging of objects is not possible or very largely prevented. Use of the escalator is thereby significantly improved and safety essentially increased.

The comb brushes can also brush away very small objects, such as sand, pebbles, dust particles, or mud, that cannot otherwise be pushed aside by the comb teeth. If these soilings penetrate into the escalator or into the escalator gear, the life of the escalator is greatly reduced and maintenance interventions become necessary. The comb brushes therefore contribute to lengthening the life of the escalator and reducing the maintenance operations.

The brushes terminate all frictional contact with the escalator user or with undesired foreign bodies before their penetration into the gap between the moving steps and the step comb can take place.

The device in patent JP2000000529 does not achieve this effect since the brushes are arranged at a distance behind the step comb. Friction between an object and the step comb and its penetration into the gap between the step and the step comb cannot be prevented.

The brushes according to the present invention are so aligned, mounted, and arranged such that the length of the brushes is approximately parallel to the comb teeth and along the comb plate and project over the step tread surface of the step running beneath. In accordance with the invention all frictional contact between two objects is prevented before penetration into the gap between the moving steps and the step comb.

In a preferred embodiment of the invention, the comb brushes are arranged on the step comb above the comb teeth. The comb brushes brush all objects away that are present on the step tread surface of the running step before they come into contact with the comb teeth. The comb teeth are thereby protected and the grooves of the step tread surface of the step are cleaned.

In a second preferred embodiment of the invention, the comb brushes are arranged on the step comb above the gaps, in other words between the comb teeth. Advantageous in this embodiment is that the ribs of the tread surface of the running step are thoroughly covered by the brushes. The comb brushes brush every object away that is present on the ribs of the tread surface of the running step before the object comes into contact with the step comb. This embodiment is particularly suitable for dealing with pebbles, since such stones often cause great damage to the step combs. The step comb is thereby protected, especially in the area of the gaps between the comb teeth, where there is no protection by the comb teeth.

In a third preferred embodiment of the invention the comb brushes are arranged in a combination of the first and second embodiments on the step comb. The comb brushes are arranged both above the comb teeth and between the comb teeth.

The comb brushes may be arranged along the entire width of the step comb. This construction allows an impenetrable barrier or obstruction that affords maximum protection. Penetration through the gaps is consequently impossible.

The comb brushes may comprise plastic, brass, or galvanized steel bristles. Through use of these materials the prevention of frictional contact is further increased. The aforesaid materials have the additional advantage that two objects that are in frictional contact can be more easily, less troublesome, or less problematically, and more reliably separated.

In a further preferred embodiment of the invention, the comb brushes are executed in special or particular colors, e.g. yellow, red, yellow/black or red/black so that improved recognition is given to the endangered or dangerous zones.

The comb brushes may be fastened onto or into the step comb by spraying, adhesive bonding, bolting, or a snap-fit connection. Inexpensive and simple usual manufacturing methods of the brushes can therefore be used.

If comb brushes are arranged on the step comb of such a comb plate of an escalator, such a step comb can be simply and inexpensively produced as a semi-finished product and then quickly and easily installed on an escalator.

In a last embodiment of the invention, an escalator with steps that has a step comb with comb teeth is modernized in that comb brushes are mounted on the step comb in approximately parallel direction to the comb teeth.

Through this modernization method, conventional transportation systems can also easily and rapidly benefit from the advantages described above.

A fuller understanding of the invention will be achieved upon consideration of exemplary embodiments of the invention as illustrated in the accompanying figures and explained in greater detail in the detailed description that follows below.

DETAILED DESCRIPTION OF THE INVENTION

Figure 1:
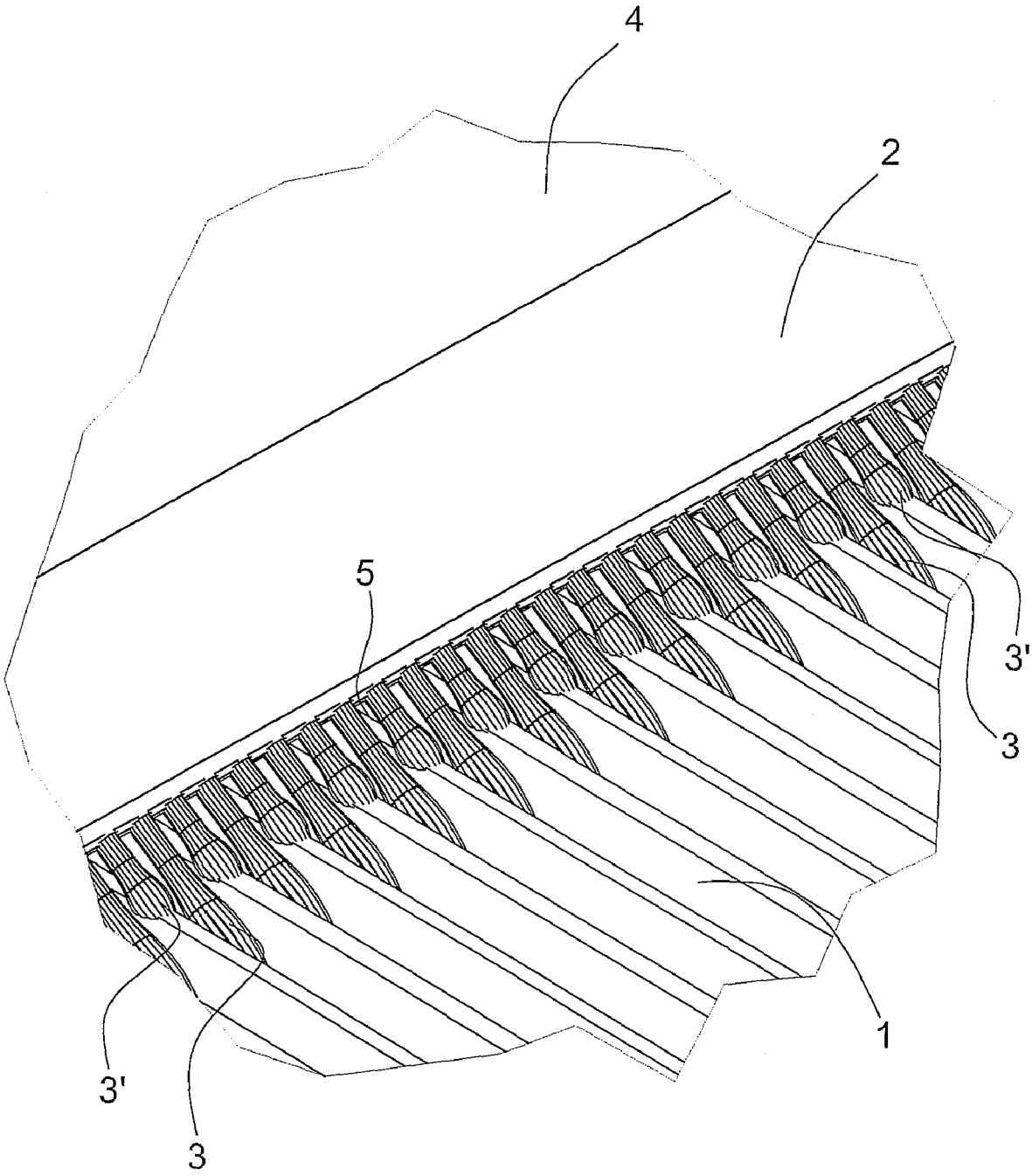
FIG. 1 is a diagrammatic perspective view of an arrangement of an escalator or moving walkway step comb with comb brushes according to the invention.

To be seen in detail in FIG. 1 is a step 1 of an escalator that has a step tread surface with ribs and a comb plate 4 with a step comb 2 in which comb brushes 3, 3' are arranged on the step comb 2 in an approximately parallel direction to the comb teeth 5. The comb brushes 3, 3' are preferably arranged along the entire width of the step comb. The comb brushes are preferably inserted on the edge or front edge of the step comb or on the front side. A moving walkway has a corresponding comb plate with a pallet comb 2 in which the brushes are likewise arranged.

By minimizing contact with the gaps between the tread surface and the comb plate, the comb brushes 3, 3' prevent jamming or dragging of shoes, umbrellas, scarves, bag straps, handbags, plastic bags, or other objects. They prevent penetration of all foreign elements: pieces of newspaper, plastic containers, pebbles, items of apparel, textile fibers, paper, cardboard, food, and coarser soiling such as snow and ice.

The gap between the comb teeth 5 and the ribbing of the escalator steps 1 is effectively narrower due to the presence of the brushes. The air gap of the passing step or step band is thus eliminated. Consequently, pinching or wedging of objects, stones or fingers is very largely prevented or no longer possible. The comb brushes 3, 3' act against the penetrating objects; they reduce the size of the air gap to almost zero millimeters and reverse the travel of objects out of the hazardous area.

The great advantage of the comb brushes 3, 3' lies in their fanlike and thus blocking arrangement. The gap between the step tread surface and the step comb is barricaded and the comb plate edge made impossible to reach. A further advantage of the comb brushes 3, 3' relative to fixed edge elements or stationary plates lies in their flexibility. Contact by footwear is thus flexibly accommodated and the space requirement needed for the specific case is released.

Like a thick wall of plastic bristles, the comb brushes 3, 3' prevent penetration into or attainment of the gap between the step comb and step tread surface. There is now a dense, hermetic, virtually impenetrable boundary of bristles between the ribs of the tread of the escalator step 1 and the lower part of the step comb 2.

The comb brushes 3, 3' can be sprayed onto, or adhesively or otherwise bonded onto, bolted onto, or snap-fit onto, and thereby fastened to, the step comb 2.

Such comb brushes 3, 3' can, for example, be yellow or red, to give passengers a clearly visible indication that a gap is present at that location. The hazard or warning is thus made unmistakably visible.

The comb brushes 3, 3' form a barrier or obstruction for the passengers and impede or hinder contact with the front edge of the step comb. No entry can be made into the step comb gap and pinching or wedging or crushing is impossible.

Furthermore, the comb brushes 3, 3' are compactly executed, such that they withstand the loading by passenger traffic. A durable, resilient, robust brush material must therefore be used, as for example plastic, brass or galvanized steel bristles. The dimensioning and design of the comb brushes 3, 3' is given by the number of passengers and the consequently resulting load, as known in the art.

FIG. 1 shows a first embodiment of a comb with comb brushes 3 positioned over the teeth (comb teeth or rake teeth 5) and with comb brushes 3' positioned over the gaps between comb teeth. This embodiment affords maximum protection and an impenetrable obstruction for foreign bodies.

Figure 2:
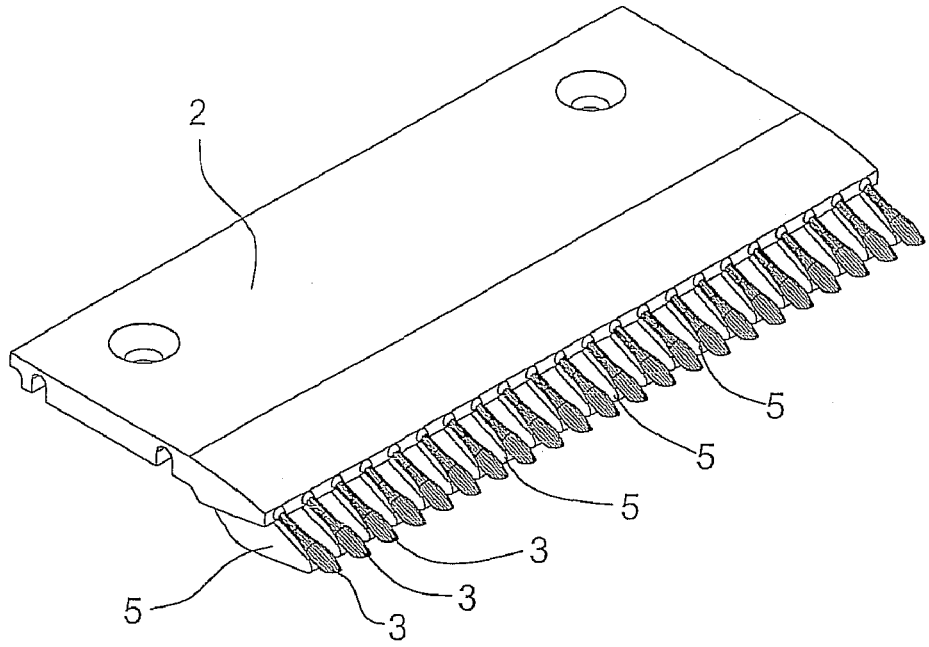
FIG. 2 is a perspective view of an embodiment of the invention in which the comb brushes are arranged on the step comb above the comb teeth.

FIG. 2 shows a second variant. This second variant, with comb brushes 3 only over the teeth/comb teeth/rake teeth 5, affords adequate protection and brushes the penetrating objects out of the step grooves and makes their penetration impossible.

Figure 3:
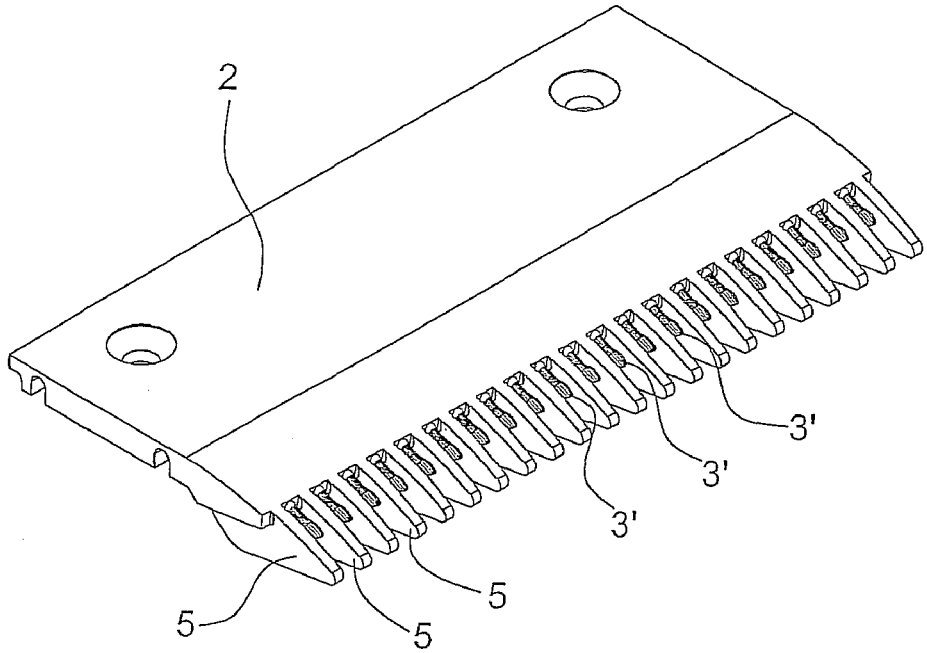
FIG. 3 is a perspective view of another embodiment of the invention in which the comb brushes are arranged on the step comb above the gaps between the comb teeth.

FIG. 3 shows a third variant, with comb brushes 3' over the gaps between the teeth 5, affords additional protection relative to current technology. The step webs are brushed and foreign objects removed. The comb teeth 5 remove the remaining larger foreign objects and ensure fault-free operation of the system.

In a preferred embodiment of the invention, the comb brushes are arranged along the entire width of the step comb. According to a further preferred embodiment of the invention, the ends of the bristles of the comb brushes are rounded. This is advantageous because the hazard of injury of passengers through contact with the bristles is reduced.

Figure 4:
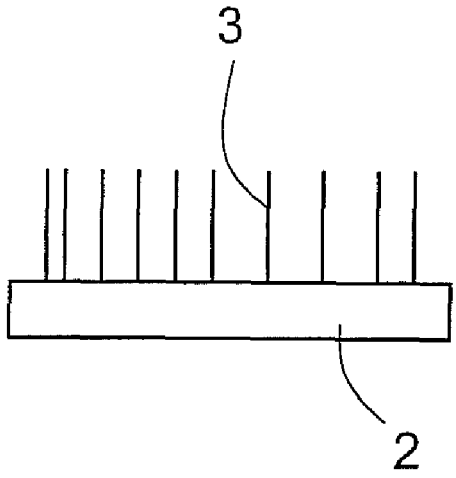
FIG. 4 is a diagrammatic elevation view of a comb brush of the invention with straight bristles.
Figure 5:
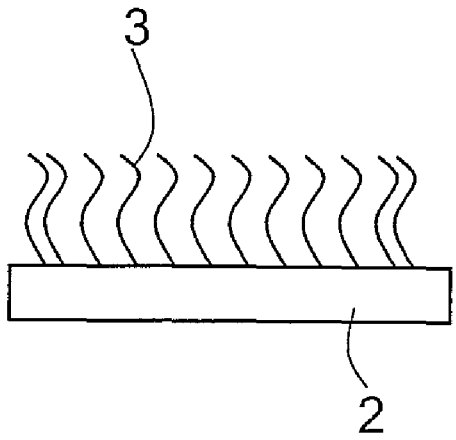
FIG. 5 is a diagrammatic elevation view of a comb brush with waved bristles.

According to a further embodiment of the invention, the bristles of the brushes may be waved. That is advantageous because such bristles have a greater stability of form and longer life. FIG. 4 shows comb brushes 3, 3' with straight bristles, while FIG. 5 shows comb brushes 3, 3' with waved bristles.

The wave structure increases the mechanical strength of the bristles and allows better distribution of the forces that are exercised by objects or passengers. The wave structure stabilizes the brushes against flexure diagonal to the longitudinal axis in comparison to the straight bristles. When straight bristles are pressed in the longitudinal axis they bend and can no longer exert a counteracting force. By contrast, the waved bristles absorb the pressure in the longitudinal axis as spring tension that is stored in the waves; the bristles retain their alignment and are not bent. In addition, through point-shaped contact with the tread surface of the step, the wave structure reduces friction.

Through their denseness the waved bristles can significantly reduce the gap or air gap between the running, driven escalator steps 1 and the step comb 2. The danger of penetration of a foot of a passenger into the gap or air gap is thereby further reduced.

On a step comb 2 for an escalator or moving walk that has comb teeth 5, the comb brushes 3, 3' can be arranged in an approximately parallel direction to comb teeth 5 in a factory assembly without difficulty. This construction allows a fast and simple mounting of the comb brushes 3, 3' on the escalator or on the moving walk and reduces manufacturing costs and mounting costs.

An escalator with steps 1 or a moving walk with pallets that has a step comb 2 or pallet comb with comb teeth 5 can also be refurbished or modernized, in that comb brushes 3, 3' are mounted on the step comb 2 or pallet comb in an approximately parallel direction to the comb teeth 5. This method of modernization by the mounting of comb brushes 3, 3' allows a fast and simple improvement to the escalator or moving walk in relation to operating safety and passenger safety, since the danger of jamming and danger of pinching and danger of wedging in the comb gaps are prevented.

On an escalator or moving walk with a balustrade, comb brushes 3, 3' may be mounted on each step comb 2. Step combs with comb brushes 3, 3' may also be installed on both the upper comb plate 4 and on the lower comb plate 4.

By its nature, the present invention can also be used on a moving walk. In this case a moving walk with pallets that have a pallet comb 2 with comb teeth 5 is retrofitted with comb brushes 3, 3' that are arranged on the pallet comb 2 in approximately parallel direction to comb teeth 5.

If the brushes are sufficiently robust and hard, the comb teeth 5 can be obviated. In this case the protective function of the comb teeth 5 is completely taken over by the comb brushes 3.

Should the tread surface of the step or pallet have no ribs, according to the invention comb brushes 3, 3' are arranged on the step comb 2 with an angle between 0 and 40° to 50°, and preferably between 0° and 40°, relative to the horizontal plane so that their protective function can be exercised.

We claim:

1. An escalator with steps that have a step comb with spaced comb teeth, characterized in that comb brushes on the step comb are arranged between the comb teeth and extend in an approximately parallel direction to a length of the comb teeth.

2. A moving walk with pallets that have a pallet comb with comb teeth, characterized in that comb brushes on the pallet comb are arranged between the comb teeth and extend in an approximately parallel direction to a length of the comb teeth.

3. An escalator or moving walk according to claim 1 or 2, characterized in that the comb brushes are arranged on the step comb or on the pallet comb over the comb teeth.

4. An escalator or moving walk according to claim 3, characterized in that the comb brushes are arranged on the step comb or on the pallet comb over gaps between the comb teeth or between the comb teeth.

5. An escalator or moving walk according to claim 3, characterized in that the comb brushes are arranged on the step comb or on the pallet comb over the comb teeth and between the comb teeth.

6. An escalator or moving walk according to claim 1 or 2, characterized in that the comb brushes have bristles chosen from at least one of a first group consisting of plastic, brass, and galvanized steel bristles and a second group consisting of yellow, yellow/black and red/black colored bristles.

7. An escalator or moving walk according to one claim 1 or 2 characterized in that the comb brushes are mounted to the step comb by at least one of a spray, and adhesive bond, bolting or a snap or wedging fit.

8. A step comb for an escalator having comb teeth characterized in that the step comb has comb brushes arranged between the comb teeth and which extend in an approximately parallel direction to a length of the comb teeth.

9. A pallet comb for an escalator having has comb teeth, characterized in that comb brushes on the pallet comb are arranged between the comb teeth and extend in an approximately parallel direction to a length of the comb teeth.

10. A method for modernizing an escalator having steps and a step comb with comb teeth, characterized in that comb brushes are mounted on the step comb between the comb teeth and extend in an approximately parallel direction to a length of the comb teeth.

11. A method for modernizing a moving walk having pallets and a pallet comb with comb teeth, characterized in that comb brushes are mounted on the pallet comb between the comb teeth and extend in an approximately parallel direction to a length of the comb teeth.

* * * * *